US005869183A

United States Patent [19]

Oka et al.

[11] Patent Number: 5,869,183

[45] Date of Patent: Feb. 9, 1999

[54] POLYMER BLEND FIBERS HAVING PHASE SEPARATION STRUCTURE AND METHOD FOR PRODUCING THE SAME

[75] Inventors: Tetsushi Oka; Seiki Nishihara; Hiroshi Yasuda, all of Ohtsu, Japan

[73] Assignee: Toyo Boseki Kabushiki Kaisha, Osaka, Japan

[21] Appl. No.: 925,110

[22] Filed: Sep. 8, 1997

Related U.S. Application Data

[63] Continuation of Ser. No. 518,859, Aug. 24, 1995, abandoned.

[30] Foreign Application Priority Data

Aug. 24, 1994 [JP] Japan ..... 6-199689

[51] Int. Cl.[6] ..... D01F 6/44; D01F 6/88

[52] U.S. Cl. ..... 428/398; 428/364; 428/397

[58] Field of Search ..... 428/364, 398, 428/397

[56] References Cited

U.S. PATENT DOCUMENTS

| | | | |
|---|---|---|---|
| 4,055,702 | 10/1977 | Guthrie | 428/398 |
| 4,371,485 | 2/1983 | Mathes | 264/46.1 |
| 4,626,390 | 12/1986 | Li | 264/46.1 |
| 5,089,135 | 2/1992 | Yoneyama | 210/500.23 |

FOREIGN PATENT DOCUMENTS

| | | |
|---|---|---|
| A-0 242 949 | 10/1987 | European Pat. Off. . |
| A-62 258 706 | 11/1987 | Japan . |
| A-01 247 435 | 10/1989 | Japan . |
| 4-209824 | 7/1992 | Japan . |
| 6-2267 | 1/1994 | Japan . |

OTHER PUBLICATIONS

Anonymous. "Blend of Polyethylene Di Carboxylate Naphthalene Polyether Imide Useful Mould Container", Derwent Publications, Ltd., AN87–360794, Research Disclosure, vol. 283, No. 038, 10 Nov. 1987.

*Primary Examiner*—Patricia A. Short
*Attorney, Agent, or Firm*—Morrison & Foerster LLP

[57] ABSTRACT

Polymer blend fibers having a phase separation structure are provided. The phase separation structure is a sea-island structure and a diameter $D_1$ on a circle basis of an island phase of the sea-island structure in a transverse cross-section of the fibers is in the range of 0.001 to 0.4 $\mu$m.

14 Claims, 6 Drawing Sheets

POLYMER BLEND FIBERS HAVING PHASE SEPARATION STRUCTURE AND METHOD FOR PRODUCING THE SAME

This application is a continuation of application Ser. No. 08/518,859, filed Aug. 24, 1995, now abandoned.

BACKGROUND OF THE INVENTION

1. Field of the Invention

The present invention relates to polymer blend fibers having a phase separation structure and a method for producing the same. More specifically, the present invention relates to polymer blend fibers capable of providing various characteristics (e.g., light-weight, water and moisture absorption, dyeability, thermal insulation, touch, water and oil repellency, and heat resistance) depending upon the use, due to a variety of precisely controlled phase separation structures.

2. Description of the Related Art

Mixed-spinning using polymer blends has been tried for the purpose of improving the characteristics of synthetic fibers. Mixed-spinning has various objectives. It is considered that synthetic fibers with their various characteristics improved can be obtained by appropriately selecting the kind of polymers constituting a polymer blend and the blend ratio thereof. Therefore, mixed-spinning has been utilized in order to improve the characteristics of synthetic fibers, such as dyeability, moisture absorption, specific gravity, a cross-linking effect, a viscoelastic property, feeling, and touch.

In the case where mixed-spinning is conducted so as to improve the characteristics of synthetic fibers, a melt spinning method is typically utilized, which uses a polymer blend composed of polymers which are incompatible with each other. This is because synthetic fibers are considered to be provided with various characteristics depending upon the use by utilizing the nonuniformity (i.e., a continuous phase and a disperse phase) of a phase separation structure formed from such a polymer blend. For example, the following use of a continuous phase and a disperse phase of a phase separation structure has been expected: (1) by allowing a component forming a disperse phase to react with an appropriate pharmaceutical agent, the disperse phase is provided with water or oil repellency. As a result, fibers with better water or oil repellency compared to those obtained by surface processing can be obtained. (2) An appropriate chemical treatment is conducted to extract a disperse phase, thereby forming hollow portions in fibers. As a result, (2-a) these hollow portions make the fibers light-weight; (2-b) the fibers are provided with a warmth retaining property because of the thermal insulating effect of the hollow portions; (2-c) the hollow portions can absorb water so that the fibers have water and moisture absorption; specifically, fibers with dry touch can be obtained; and (2-d) fibers are provided with dyeability by allowing the hollow portions to accomodate a dye.

However, in the case where melt spinning is conducted by using a polymer blend composed of polymers which are incompatible with each other, it is substantially difficult to obtain a stable polymer blend melt. For this reason, the melts of polymers constituting the polymer blend are extruded from different nozzles and polymer melts are physically mixed at the time of extrusion, whereby melt spinning is conducted. According to such physical mixing, fibers having a precisely controlled phase separation structure cannot be obtained easily. Thus, it is substantially impossible to obtain various phase separation structures depending upon the use by this method.

In order to solve the above-mentioned problems, Japanese Laid-Open Patent Publication No. 4-209824 discloses a method of preparing a polymer blend melt composed of polymers which are incompatible with each other by using a compatibilizer, thereby conducting melt spinning. Japanese Laid-Open Patent Publication No. 6-2267 discloses composite fibers obtained by extruding polymer blends each forming a sea-island structure and each having a particular difference in fusion viscosity so as to attach to each other.

However, these attempts do not control the phase separation itself, and as a result, the substantial problems of polymer blends composed of polymers which are incompatible with each other cannot be solved. More specifically, in melt spinning using such polymer blends, the following problems remain unsolved: (a) fibers cannot be provided with desired characteristics depending upon the use because of difficulties with phase separation control; (b) high-speed spinning is difficult to conduct due to unsatisfactory spinnability, resulting in poor productivity; (c) since the size and the variation in size of a disperse phase are large, mechanical characteristics of fibers to be obtained are insufficient; and (d) compatibilizers or the like is required to be used, so that costs increase.

As described above, polymer blend fibers having a precisely controlled phase separation structure and a method for easily producing such fibers are desired.

SUMMARY OF THE INVENTION

According to one aspect of the present invention, polymer blend fibers have a phase separation structure, wherein the phase separation structure is a sea-island structure, and a diameter $D_1$ on a circle basis of an island phase of the sea-island structure in a transverse cross-section of the fibers is in the range of 0.001 to 0.4 $\mu$m.

According to another aspect of the present invention, polymer blend fibers have a phase separation structure, wherein the phase separation structure is a sea-island structure, and a diameter $D_1$ on a circle basis of an island phase of the sea-island structure in a transverse cross-section of the fibers and a diameter $D_2$ on a circle basis of the island phase of the sea-island structure in the longitudinal cross-section of the fibers have a relationship of $D_2/D_1<2.0$.

In one embodiment of the present invention, the diameter $D_1$ on a circle basis of the island phase of the sea-island structure in the transverse cross-section of the fibers is in the range of 0.01 to 0.4 $\mu$m.

In another embodiment of the present invention, the diameter $D_1$ on a circle basis of the island phase of the sea-island structure in the transverse cross-section of the fibers is in the range of 0.005 to 0.1 $\mu$m.

In still another embodiment of the present invention, the diameter $D_1$ on a circle basis of the island phase of the sea-island structure in the transverse cross-section of the fibers is in the range of 0.01 to 0.1 $\mu$m.

In still another embodiment of the present invention, an average area X of the island phase of the sea-island structure in the transverse cross-section of the fibers is 0.15 $\mu m^2$ or less, and a variation index Y is 2.0 or less.

According to still another aspect of the present invention, the phase separation structure is a modulated structure, and a diameter $D_1$ on a circle basis of a disperse phase of the modulated structure in a transverse cross-section of the fibers is in the range of 0.001 to 5 $\mu$m.

In one embodiment of the present invention, the diameter $D_1$ on a circle basis of the disperse phase of the modulated structure in the transverse cross-section of the fibers is in the range of 0.001 to 0.4 μm.

In another enbodiment of the present invention, the diameter $D_1$ on a circle basis of the disperse phase of the modulated structure in the transverse cross-section of the fibers is in the range of 0.005 to 0.1 μm.

In still another embodiment of the present invention, the diameter $D_1$ on a circle basis of the disperse phase of the modulated structure in the transverse cross-section of the fibers is in the range of 0.01 to 0.1 μm.

According to still another aspect of the present invention, the phase separation structure is a spongy structure, and a diameter $D_1$ on a circle basis of a hollow portion of the spongy structure in a transverse cross-section of the fibers is in the range of 0.001 to 5 μm.

In one embodiment of the present invention, the diameter $D_1$ on a circle basis of the hollow portion of the spongy structure in the transverse cross-section of the fibers is in the range of 0.001 to 0.4 μm.

In another embodiment of the present invention, the diameter $D_1$ on a circle basis of the hollow portion of the spongy structure in the transverse cross-section of the fibers is in the range of 0.005 to 0.1 μm.

In still another embodiment of the present invention, the diameter $D_1$ on a circle basis of the hollow portion of the spongy structure in the transverse cross-section of the fibers is in the range of 0.01 to 0.1 μm.

In the above-mentioned aspects, the polymer blend fibers are composed of a partial compatible polymer blend.

In the above-mentioned aspects, the partial compatible polymer blend has an upper critical solution temperature.

In the above-mentioned aspects, the partial compatible polymer blend contains a copolymer having a degree of polymerization of 50 or more.

In the above-mentioned aspects, the copolymer has ethyleneterephthalate as a monomer unit.

In the above-mentioned aspects, the partial compatible polymer blend is a blend containing a polyethyleneterephthalate-polyethylenenaphthalate copolymer and a polyetherimide.

In the above-mentioned aspects, a molar ratio between an ethyleneterephthalate unit and an ethylenenaphthalate unit in the polyethyleneterephthalate-polyethylenenaphthalate copolymer is in the range of 98:2 to 50:50.

In the above-mentioned aspects, the polyetherimide is represented by the following Chemical Formula I:

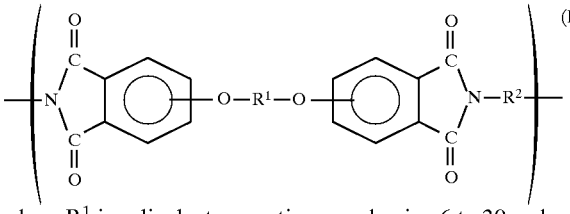

(I)

where $R^1$ is a divalent aromatic group having 6 to 30 carbon atoms, and $R^2$ is a divalent aromatic group having 6 to 30 carbon atoms, an alkylene group or a cycloalkylene group having 2 to 20 carbon atoms, or a polyorganosiloxane group which is chain-terminated with an alkylene group having 2 to 8 carbon atoms.

In the above-mentioned aspects, polymer blend fibers contain a polymer having a high degree of polymerization and a polymer having a low degree of polymerization, and a degree of polymerization $n_1$ of the polymer having a high degree of polymerization and a degree of polymerization $n_2$ of the polymer having a low degree of polymerization have a relationship of $n_1/n_2 \leqq 50$.

In the above-mentioned aspects, polymer blend fibers contain a crystalline polymer.

In the above-mentioned aspects, polymer blend fibers are composed of polystyrene and poly-ε-caprolactone.

According to still another aspect of the present invention, a method for producing polymer blend fibers includes the steps of: mixing two kinds of polymers to prepare a polymer blend and melting the polymer blend to prepare a homogeneous polymer blend melt; extruding the polymer blend melt to form fibers; and heat-treating the fibers to form a phase separation structure in the fibers.

In one embodiment of the present invention, the polymer blend has an upper critical solution temperature.

In another embodiment of the present invention, the heat treatment is conducted at a temperature in the range of a glass transition temperature of the polymer blend to a binodal temperature thereof.

In still another embodiment of the present invention, the heat treatment is conducted in the range of a spinodal temperature of the polymer blend to the binodal temperature thereof.

In still another embodiment of the present invention, one of the polymer contained in the polymer blend is a crystalline polymer.

In still another embodiment of the present invention, the polymer blend is composed of polystyrene and poly-ε-caprolactone.

In still another embodiment of the present invention, the polymer blend contains a polyethyleneterephthalate-polyethylenenaphthalate copolymer and a polyetherimide.

In still another embodiment of the present invention, the method further includes the step of taking up the fibers using a roller after the extruding step, and the physical or chemical treatment is conducted between the extruding and taking up steps.

In still another embodiment of the present invention, the method further includes the step of drawing the fibers after the extruding step, wherein the physical and chemical treatment is conducted in the drawing step.

In still another embodiment of the present invention, the method further includes the steps of weaving the fibers into fabric and dyeing the fabric, after the extruding step, wherein the physical or chemical treatment is conducted in the dyeing step.

In still another embodiment of the present invention, the method further includes the steps of weaving the fibers into fabric and scouring the fabric, after the extruding step, wherein the physical or chemical treatment is conducted in the scouring step.

In still another embodiment of the present invention, the method further includes the step of alkaline reduction treatment after the step of physical or chemical treatment.

Thus, the invention described herein makes possible the advantages of (1) providing polymer blend fibers capable of providing various characteristics (e.g., light-weight, water and moisture absorption, dyeability, thermal insulation, touch, water and oil repellency, heat resistance) depending upon the use, due to a variety of precisely controlled phase separation structures; (2) providing polymer blend fibers having a small phase separation structure and outstanding mechanical properties; (3) providing polymer blend fibers exhibiting a narrow range of variation in phase separation structures and having unvariable quality; (4) providing polymer blend fibers which are advantageous in terms of cost, as requiring no compatibilizer etc.; (5) providing polymer blend fibers having outstanding productivity due to the capability of being taken up at high speed; and (6) providing a method for easily producing such polymer blend fibers.

These and other advantages of the present invention will become apparent to those skilled in the art upon reading and understanding the following detailed description with reference to the accompanying figures.

DESCRIPTION OF THE PREFERRED EMBODIMENTS

1. Description of Terminology

Various terms and parameters used in the present specification are defined as follows:

The term "fibers" refers to filaments in a broad sense. Thus, the fibers used in the present specification may include drawn yarn, undrawn yarn, long fibers, and short fibers.

The term "compatible state" refers to a state in which at least two polymers are homogeneously mixed at a molecular level, i.e., a one-phase structure. Specifically, in the compatible state, polymers are homogeneously mixed in such a manner as not to allow the formation of domains having an average size of 0.001 $\mu$m or more. The term "incompatible state" refers to a state in which domains having an average size of 0.001 $\mu$m or more are formed, i.e., a two-phase structure. The two-phase structure in the incompatible state is referred to as "phase separation structure". The analysis of the compatible state and the incompatible state are conducted by known analytical techniques such as using an electron microscope and a differential scanning calorimeter (DSC). Such an analysis is described in detail in, for example, Polymer Alloys and Blends, Leszek A Utracki, Hanser Publishers, Munich Vienna New York, p. 64.

The term "compatible polymer blend" refers to a polymer blend in a compatible state at a practically selectable temperature irrespective of the blend ratio of polymers constituting the polymer blend. The term "incompatible polymer blend" refers to a polymer blend in an incompatible state at a practically selectable temperature irrespective of the blend ratio of polymers constituting the polymer blend. The term "partial compatible polymer blend" refers to a polymer blend which is capable of being in a compatible state or in an incompatible state at a practically selectable temperature by appropriately changing the blend ratio of polymers constituting the polymer blend. Herein, "practically selectable temperature" refers to a temperature in the range of a glass transition temperature of a polymer blend (the lowest glass transition temperature in the case where a polymer blend has a plurality of glass transition temperatures) to a decomposition temperature thereof.

Figure 1:
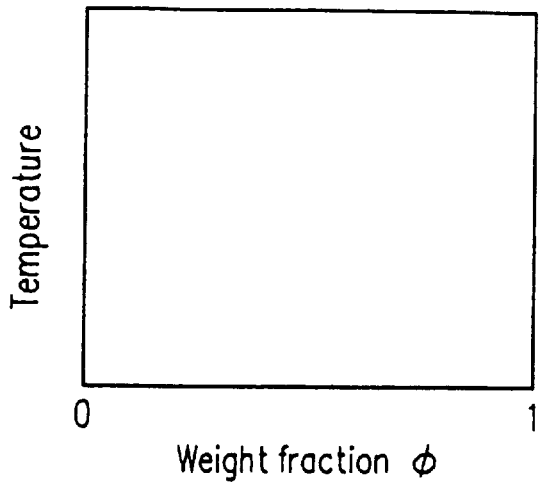
FIG. 1 is a schematic phase diagram of a compatible polymer blend.
Figure 2:
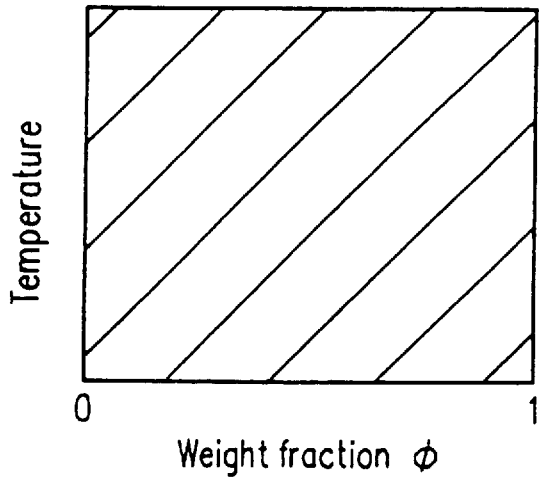
FIG. 2 is a schematic phase diagram of an incompatible polymer blend.
Figure 3:
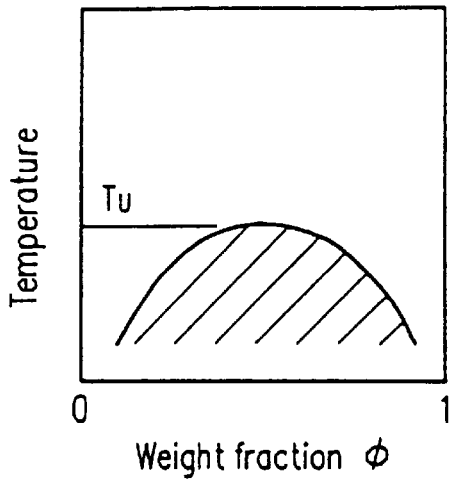
FIG. 3 shows an example of a schematic phase diagram of a partial compatible polymer blend.
Figure 4:
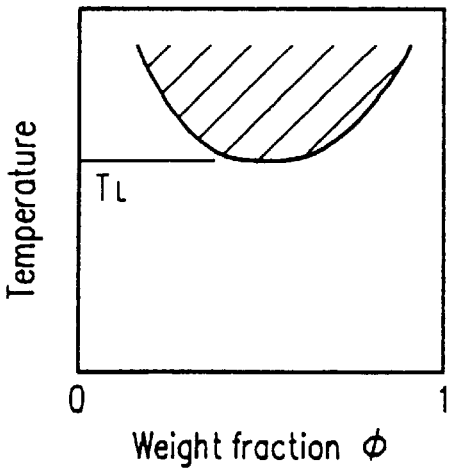
FIG. 4 shows another example of a schematic phase diagram of a partial compatible polymer blend.
Figure 5:
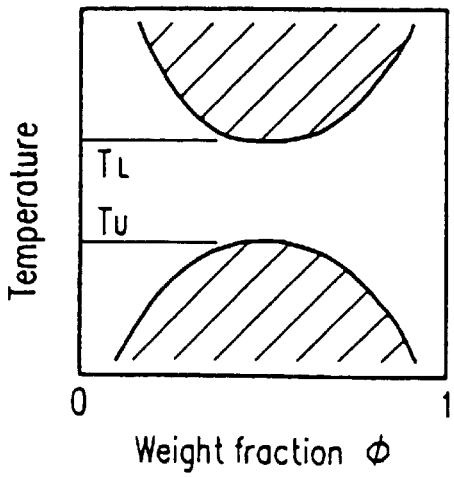
FIG. 5 shows still another example of a schematic phase diagram of a partial compatible polymer blend.

The compatible, incompatible, and partial compatible polymer blends will be described with reference to phase diagrams. A phase diagram shows the relationship between the blend ratio of a polymer blend (weight fraction) and the phase separation temperature (i.e., temperature at which the polymer blend shifts from a compatible state to an incompatible state). FIG. 1 is a schematic phase diagram of a compatible polymer blend; FIG. 2 is a schematic phase diagram of an incompatible polymer blend; FIGS. 3 to 5 are schematic phase diagrams of a partial compatible polymer blend. In FIGS. 1 to 5, the shaded portion represents an incompatible state; the portion other than the shaded portion represents a compatible state. In FIGS. 1 to 5, the upper limit of the vertical axis represents a decomposition temperature of the polymer blend. The lower limit thereof represents a glass transition temperature of the polymer blends (the lowest glass transition temperature, in the case where a polymer blend has a plurality of glass transition temperatures). As is apparent from FIG. 1, the compatible polymer blend is in a compatible state at a practically selectable temperature. As is apparent from FIG. 2, the incompatible polymer blend is in an incompatible state at a practically selectable temperature. As is apparent from FIGS. 3 to 5, the partial compatible polymer blend can be typically represented by three types of phase diagrams. $T_u$ in FIG. 3 is called upper critical solution temperature (UCST), and the phase diagram of FIG. 3 is called a UCST-type phase diagram. $T_L$ of FIG. 4 is called lower critical solution temperature (LCST), and the phase diagram of FIG. 4 is called an LCST-type phase diagram. The phase diagram of FIG. 5 is called a mirror-image-type phase diagram.

Figure 6:
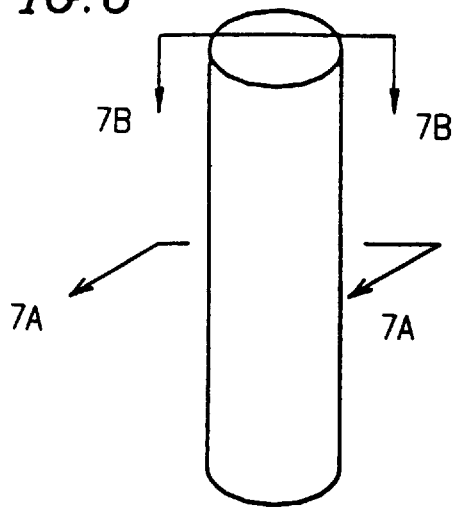
FIG. 6 is a schematic perspective view of polymer blend fibers of the present invention.
Figure 7A:
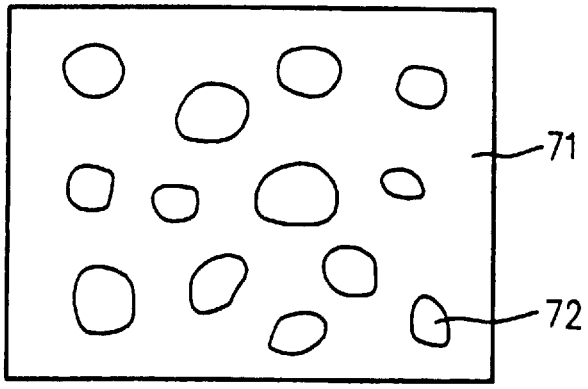
FIG. 7A is a schematic diagram showing a sea-island structure in a cross-section taken along line A—A of FIG. 6.
Figure 7B:
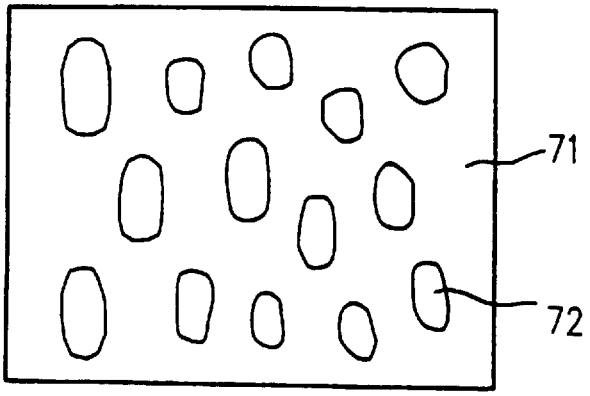
FIG. 7B is a schematic diagram showing a sea-island structure in a cross-section taken along line B—B of FIG. 6.
Figure 8A:
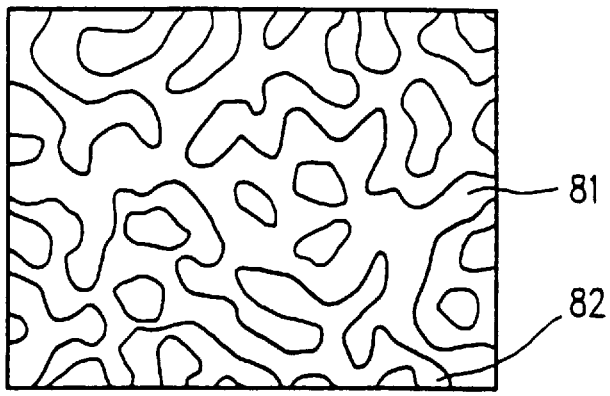
FIG. 8A is a schematic diagram showing a modulated structure in a cross-section taken along line A—A of FIG. 6.
Figure 8B:
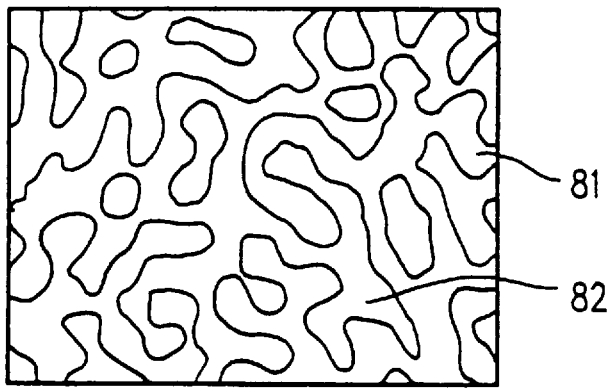
FIG. 8B is a schematic diagram showing a modulated structure in a cross-section taken along line B—B of FIG. 6.
Figure 9A:
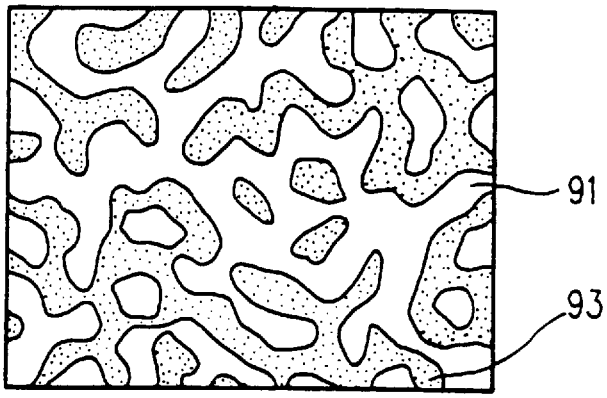
FIG. 9A is a schematic diagram showing a spongy structure in a cross-section taken along line A—A of FIG. 6.
Figure 9B:
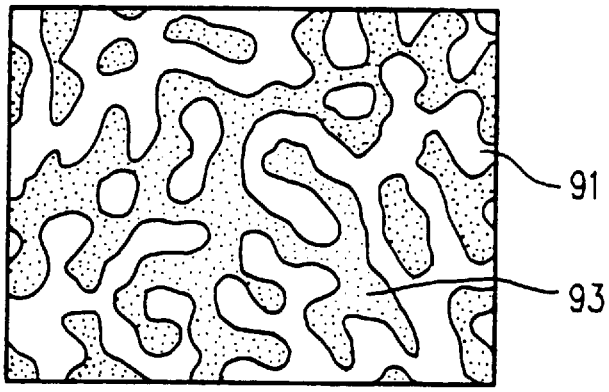
FIG. 9B is a schematic diagram showing a a spongy structure in a cross-section taken along line B—B of FIG. 6.

Next, the phase separation structure formed in the polymer blend fibers of the present invention will be described. In the present invention, for simplicity, the phase separation structure is classified into three types: "sea-island structure", "modulated structure", and "spongy structure". The phase separation structure in a transverse cross-section (taken along line A—A ) of fibers shown in FIG. 6 is shown in FIG. 7A (sea-island structure), FIG. 8A (modulated structure), and FIG. 9A (spongy structure); The phase separation structure in a longitudinal cross-section (taken along line B—B) of the fibers shown in FIG. 6 is shown in FIG. 7B (sea-island structure), FIG. 8B (modulated structure), and FIG. 9B (spongy structure). As shown in FIGS. 7A and 7B, in the sea-island structure, the domain of each component is clearly separated into a continuous phase (sea phase) 71 and a disperse phase (island phase) 72. In the modulated structure and the spongy structure described below, a continuous phase and a disperse phase are not clearly formed; however, for convenience's sake, the domain of a component whose proportion in a polymer blend is smaller is referred to as a disperse phase and the domain of a component whose proportion in the polymer blend is larger is referred to as a continuous phase. As shown in FIGS. 8A and 8B, in the modulated structure, a disperse phase 82 is three-dimensionally connected. As shown in FIGS. 9A and 9B, in the spongy structure, the disperse phase assumes a porous structure having hollow portions 93 by chemical treatment such as extraction.

Furthermore, the term "spinodal temperature" refers to a boundary temperature between the temperature of phase separation caused by spinodal decomposition and the temperature of phase separation caused by nucleation and growth. The term "binodal temperature" refers to a so-called phase separation temperature, i.e., a boundary temperature at which a polymer blend shifts from a compatible state to an incompatible state. These terms are well known in the field of polymer chemistry and described in detail in, for example, Polymer Alloys and Blends, Leszek A Utracki, Hanser Publishers, Munich Vienna New York, p. 32.

The definition of parameters used in the present specification will be described. "Diameter D on a circle basis", "average area X", and "variation index Y" are all parameters qualitatively representing an average size of the phase separation structure. A specific method of determining the diameter on a circle basis, the average area, and the variation index in the sea-island structure, and the diameter on a circle basis in the modulated structure and the spongy structure will be described below. Regarding the diameter on a circle basis, the diameter on a circle basis of a transverse cross-section of fibers (i.e., a plane vertical to the fiber axis) and the diameter on a circle basis of a longitudinal cross-section of fibers (i.e., a plane in the direction of the fiber axis) are assumed to be $D_1$ and $D_2$, respectively.

(i) Sea-island structure

Twenty island phases are arbitrarily selected from an electron microphotograph in a transverse cross-section or a longitudinal cross-section of fibers in a predetermined magnification. The area of each island phase is calculated from the weight of the entire micro-photograph and the weight of cut-out portions corresponding to the selected island phases. The areas of 20 island phases are averaged, and the average is assumed to be an average area X. Furthermore, the diameter D on a circle basis is determined by using the following formula of a circle.

$$D=2\cdot(X/\pi)_{1/2}$$

"Variation index" is a parameter showing the degree of variation of the average area X of the island phases. "Variation index Y" is determined by the following formula:

$$Y=(X_{max}-X_{min})/X$$

where X is the above-mentioned average area, $X_{max}$ is an average of the largest 3 areas of the arbitrarily selected 20 island phases, and $X_{min}$ is an average of the smallest 3 areas of the arbitrarily selected 20 island phases. (Y becomes 1, when the areas of the respective island phases are uniform.)

(ii) Modulated structure

Figure 10:
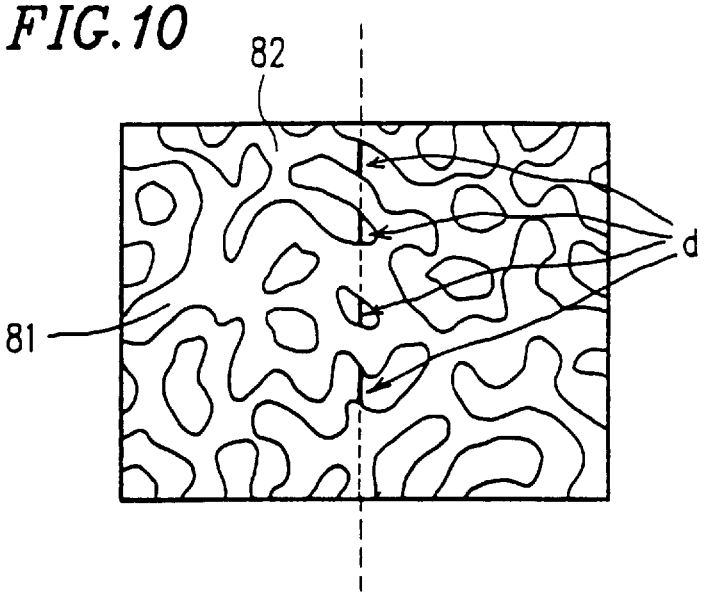
FIG. 10 is a schematic diagram showing the method of obtaining a diameter D on a circle basis of the modulated structure.

As shown in FIG. 10, a straight line is drawn along the transverse cross-section or the longitudinal cross-section of the fibers in the electron microphotograph. A distance of the disperse phase 82, which this straight line passes through, is assumed to be d. The average of d of arbitrarily selected 20 island phases is assumed to be the diameter D on a circle basis.

(iii) Spongy structure

The diameter D on a circle basis of the hollow portions is determined in the same way as in the modulated structure.

2. Detailed Description of the Invention

The polymer blend fibers of the present invention have a phase separation structure. Examples of the phase separation structure include a sea-island structure, a modulated structure, and a spongy structure. The phase separation structure of the polymer blend fibers of the present invention has a very small average size. For example, in the case of the sea-island structure, the diameter $D_1$ on a circle basis of an island phase in the transverse cross-section of the fibers is in the range of 0.001 to 0.4 $\mu$m, preferably 0.005 to 0.1 $\mu$m, and more preferably 0.01 to 0.1 $\mu$m. In the case of the modulated structure, the diameter $D_1$ on a circle basis of a disperse phase in a transverse cross-section of the fibers is in the range of 0.001 to 5 $\mu$m, preferably 0.001 to 0.4 $\mu$m, more preferably 0.005 to 0.1 $\mu$m, and most preferably 0.01 to 0.1 $\mu$m. Furthermore, in the case of the spongy structure, the diameter $D_1$ on a circle basis of hollow portions in the transverse cross-section of the fibers is in the range of 0.001 to 5 $\mu$m, preferably 0.001 to 0.4 $\mu$m, more preferably 0.005 to 0.1 $\mu$m, and most preferably 0.01 to 0.1 $\mu$m. In any case, when the diameter $D_1$ on a circle basis is less than 0.001 $\mu$m, the phase structure is substantially a one-phase structure; therefore, various characteristics cannot be provided to the fibers by utilizing the nonuniformity of the phase separation structure. When the diameter $D_1$ on a circle basis is more than 0.4 $\mu$m (sea-island structure) or 5 $\mu$m (modulated structure and spongy structure), the phase separation structure is too nonuniform, so that the following problems sometimes arise: (a) desired characteristics depending upon the use cannot be effectively provided to the fibers; (b) the strength of the fibers to be obtained is insufficient; and (c) a compatibilizer is required to be used, greatly increasing cost.

In the case where the phase separation structure is a sea-island structure and the average area X and the variation index Y of island phases are used as parameters showing an average size of the phase separation, the average area X is preferably 0.15 $\mu m^2$ or less, and more preferably 0.10 $\mu m^2$ or less. When the average area X is more than 0.15 $\mu m^2$, the phase separation structure is too nonuniform, so that the following problems sometimes arise: (a) desired characteristics depending upon the use cannot be effectively provided to the fibers; (b) the strength of the fibers to be obtained is insufficient; and (c) a compatibilizer is required to be used, greatly increasing cost. The variation index Y is preferably 2.0 or less, and more preferably 1.7 or less. When the variation index Y is more than 2.0, quality of the fibers to be obtained is greatly changed. For example, fibers with insufficient strength are obtained, and dyed spots are generated in the fibers.

The phase separation structure of the polymer blend fibers of the present invention has a particular shape even in three dimensions. In the case where the phase separation structure is a sea-island structure, the diameter $D_1$ on a circle basis of the island phases in the transverse cross-section of the fibers and the diameter $D_2$ on a circle basis of the island phases in the longitudinal cross-section of the fibers has a relationship: $D_2/D_1 \leqq 2.0$, preferably $D_2/D_1 \leqq 1.5$. In the case where the phase separation structure is a modulated structure, the diameter $D_1$ of a circle basis of the disperse phases in the transverse cross-section of the fibers and the diameter $D_2$ on a circle basis of the disperse phases in the longitudinal cross-section of the fibers has a relationship: $D_2/D_1 \leqq 2.0$, preferably $D_2/D_1 \leqq 1.5$. Furthermore, in the case where the phase separation structure is a spongy structure, the diameter $D_1$ on a circle basis of the hollow portions in the transverse cross-section of the fibers and the diameter $D_2$ on a circle basis of the hollow portions in the longitudinal cross-section of the fibers has a relationship: $D_2/D_1 \leqq 2.0$, preferably $D_2/D_1 \leqq 1.5$. When $D_2/D_1$ is more than 2.0, desired dyeability and touch cannot be obtained in most cases.

The phase separation structure (in particular, the sea-island structure and the modulated structure) can be formed by cooling, drawing, and heat-treatment at the time of extrusion; heat-treatment of formed fibers and providing water thereto; and dyeing and refining fabric obtained from the fibers. In order to form a variety of precisely controlled phase separation structures, heat-treatment of the formed fibers described later are particularly preferred. Furthermore, the spongy structure can be formed by conducting chemical treatment such as extraction to the fibers having a phase separation structure (in particular, modulated structure). The extraction can be conducted preferably by using a good solvent with respect to a disperse phase component.

Polymer blends which can be used in the present invention are not particularly limited, as long as they are capable of forming the above-mentioned phase separation structure. Preferred polymer blends will be specifically described.

The polymer blends which can be used in the present invention are preferably partial compatible polymer blends, that is, those having UCST, those having LCST, and those having UCST and LCST, at a practically selectable temperature. The polymer blends having UCST are preferred. The reasons for this are as follows: the polymer blends having UCST (A) are capable of expressing a phase separation structure only by cooling at the time of extrusion, in the case where a cooling rate at the time of extrusion is low; and (B) are capable of expressing a phase separation structure while retaining the shape of the fibers by heat treating the formed fibers, in the case where the cooling rate at the time of extrusion is high. In the case where the cooling rate at a time of extrusion is high, the fibers are formed while molecules are frozen in a compatible state and the mobility of the molecules is increased by heating the formed fibers; and as a result, a phase separation occurs.

Considering the fiber forming property, one of the polymers constituting the above-mentioned partial compatible polymer blend is preferably a crystalline polymer. That is, in the case where all of the polymers constituting the polymer blend are non-crystalline polymers, the fiber forming property is insufficient in most cases. Crystalline polymers are not particularly limited, and any of known crystalline polymers can be used. Examples of the crystalline polymers which can be used in the present invention include aromatic polyesters such as polyethyleneterephthalate, polyethylenenaphthalate, polybutyleneterephthalate, and copolymers thereof; aliphatic polyesters such as poly-ε-caprolactone; aliphatic polyamides such as nylon 6 and nylon 66; polyolefins such as polyethylene and polypropylene; vinyl polymers such as polyvinyl alcohol and polyvinyl chloride; and polyethers such as polyoxymethylene.

The particularly preferred polymer blend containing a crystalline polymer is a blend containing polystyrene and poly-ε-caprolactone.

Preferably, the other one of the polymers constituting the above-mentioned partial compatible polymer blend is a copolymer having a degree of polymerization of 50 or more. The partial compatible polymer blend containing a copolymer is basically composed of the following combination: a copolymer A having monomer units a and b and a homopolymer C or a copolymer D; it is noted that in the case where a homopolymer E has only a monomer unit a, the homopolymer E should form a compatible polymer blend with the homopolymer C or the copolymer D, and in the case where a homopolymer F has only a monomer unit b, the homopolymer F should form an incompatible polymer blend with the homopolymer C or the copolymer D.

Considering the cost and mechanical characteristics, particularly preferred copolymers are those containing ethyleneterephthalate as a monomer unit. Examples of such copolymers include a polyethyleneterephthalate-polyethylenenaphthalate copolymer and a polyethyleneterephthalate-polybutyleneterephthalate copolymer.

The particularly preferred polymer blend containing a copolymer is a blend containing a polyethyleneterephthalate-polyethylenenaphthalate copolymer and polyetherimide and a blend containing a polyethyleneterephthalate-polybutyleneterephthalate copolymer and a chlorinated polyethylene. Furthermore, particularly preferred polyetherimide is represented by the following Chemical Formula I:

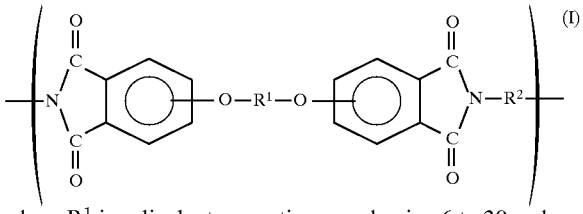

(I)

where $R^1$ is a divalent aromatic group having 6 to 30 carbon atoms, and $R^2$ is a divalent aromatic group having 6 to 30 carbon atoms, an alkylene group or a cycloalkylene group having 2 to 20 carbon atoms, or a polyorganosiloxane group which is chain-terminated with an alkylene group having 2 to 8 carbon atoms.

The preferred molar ratio of the monomer units contained in the copolymer will vary depending upon the kind of polymers to be used for the polymer blend. For example, in the case of a blend containing polyethyleneterephthalate-polyethylenenaphalate copolymer and polyetherimide, the molar ratio between an ethyleneterephthalate unit and an ethylenenaphthalate unit is in the range of preferably 98:2 to 50:50, more preferably 95:5 to 70:30. When the molar proportion of the ethyleneterephthalate unit is more than 98, the polymer blend becomes an incompatible polymer blend. Thus, fibers with their phase separation structure precisely controlled cannot be obtained. Consequently, the mechanical characteristics of the fibers to be obtained are likely to be insufficient. When the molar proportion of the ethylenenaphthalate unit is less than 65, the polymer blend becomes a compatible polymer blend. Thus, fibers having a phase separation structure cannot be obtained. Consequently, non-uniformity of the phase separation structure cannot be utilized, resulting in the difficulty in providing desired characteristics to the fibers depending upon the use.

The polymer blend which can be used in the present invention contains a polymer having a high degree of polymerization and a polymer having a low degree of polymerization, and a degree of polymerization $n_1$ of the polymer having a high degree of polymerization and a degree of polymerization $n_2$ of the polymer having a low degree of polymerization have a relationship of $n_1/n_2 \leqq 50$, more preferably $n_1/n_2 \leqq 20$, and most preferably $n_1/n_2 \leqq 10$. When $n_1/n_2$ is more than 50, in some cases, the polymer having a low degree of polymerization works as a solvent with respect to the polymer having a high degree of polymerization. As a result, the phase separation speed extremely increases, so that there is a possibility that the reproducibility of formation of the phase separation structure becomes insufficient. Furthermore, in some cases, the polymer having a low degree of polymerization volatilizes after the lapse of a long period of time and hence, the fibers to be obtained have insufficient storing stability.

If required, various additives can be added to the polymer blend which can be used in the present invention. Examples of the additives include carbon black, titanium oxide, aluminum oxide, silicon oxide, calcium oxide, mica, metal fine powders, organic pigment, inorganic pigment, antioxidant, fluorescent whitening agent, flame retardant, anti-static agent, water repellent, moisture absorbing agent, water absorbing agent, viscosity regulating agent, and UV-ray absorbent.

Hereinafter, a preferred example of a method for producing the polymer blend fibers of the present invention will be described.

First, a melt of the above-mentioned polymer blend is prepared. This melt can be prepared by directly melt-mixing the above-mentioned preferred polymers in a spinning apparatus or can be prepared by melt-kneading the preferred polymers to form polymer blend pellets for spinning and melting the pellets in a spinning apparatus again. It is more preferred that polymer blend pellets for spinning are prepared. The melt temperature can vary depending upon the kind and the blend ratio of the polymer blend; for example, in the case of a blend containing polyethyleneterephthalate-polyethylenenaphthalate copolymer and polyetherimide in a weight ratio of 70:30, the melt temperature is in the range of preferably 310° to 330° C., more preferably 310° to 320° C.

Next, the polymer blend melt is extruded from the apparatus to form polymer blend fibers. The extruding conditions can vary depending upon the kind and the blend ratio of the polymer blend and the use of fibers; however, ordinary conditions can be used. For example, the nozzle plate temperature is in the range of preferably 310° to 330° C., more preferably 310° to 320° C.; the extruded amount per nozzle plate is in the range of preferably 0.5 g/min. and hole to 2.0 g/min. and hole, more preferably 0.6 g/min. and hole to 1.0 g/min. and hole.

Then, the fibers thus formed are physically or chemically treated to form a phase separation structure in the fibers. The physical or chemical treatment can be conducted at this stage or at any other stages described later. As the physical or chemical treatment, heat treatment is particularly preferred. Specific conditions of the heat treatment will be described below. The heat treatment temperature can vary depending upon the type of the polymer blend (i.e., UCST-type, LCST-type, and mirror-image-type). For example, in the case of the UCST-type polymer blend, the heat treatment temperature is in the range of preferably a glass transition temperature of the polymer blend to a binodal temperature thereof. Alternatively, the heat treatment temperature is in the range of preferably a spinodal temperature of the polymer blend to a binodal temperature thereof. The heat treatment time can vary depending upon the heat treatment temperature and the desired phase separation structure. For example, in the case of forming the modulated structure, the heat treatment for a short period of time is preferred. Specifically, the heat treatment time is in the range of preferably 0.01 to 1,800 seconds, more preferably 0.1 to 120 seconds. By selecting the heat treatment temperature and time in these ranges, a variety of precisely controlled phase separation structures can be formed.

Preferably, the fibers thus formed can be taken up by a roller. The taking-up speed is in the range of preferably 300 m/min. to 6,000 m/min., more preferably 400 m/min. to 3,000 m/min.

Preferably, the fibers thus formed can be drawn by method known to those skilled in the art. A drawing ratio is in the range of preferably 1.5 to 6.0 times, more preferably 2.0 to 4.0 times.

Preferably, the fibers thus formed can be dyed by method known to those skilled in the art. A dye, a pigment, dyeing conditions, and the like are not particularly limited.

Preferably, the fibers thus formed can be scoured by method known to those skilled in the art. The scouring method is not particularly limited.

Preferably, the fibers thus formed can be subjected to alkaline reduction treatment by method known to those skilled in the art. The treatment conditions are not particularly limited.

Although the fineness of the fibers thus obtained can vary depending upon the use, it is in the range of preferably 0.1 to 20 deniers, more preferably 0.3 to 5 deniers.

The polymer blend fibers of the present invention can have a variety of precisely controlled phase separation structures (a sea-island structure, a modulated structure, or a spongy structure). The polymer blend fibers of the present invention can be provided with various functions to a desired degree depending upon the use by utilizing a variety of nonuniformities of the phase separation structure. For example, (1) by allowing a component forming a disperse phase to react with an appropriate pharmaceutical agent, the disperse phase is provided with water or oil repellency. As a result, fibers with better water or oil repellency compared to those obtained by surface processing can be obtained. (2) An appropriate chemical treatment is conducted to extract a disperse phase, thereby forming a spongy structure (i.e., a phase separation structure having hollow portions). As a result, (2-a) these hollow portions make the fibers light-weight; (2-b) the fibers are provided with outstanding warmth retaining property by a thermal insulating effect of the hollow portions; (2-c) the hollow portions can absorb water, so that the fibers have outstanding water and moisture absorption; specifically, fibers with dry touch can be obtained; and (2-d) fibers are provided with outstanding dyeability by allowing the hollow portions to accomodate a dye. (3) In the case where the phase separation structure is a modulated structure, phases assume a very complicated state. Thus, by using a heat-resistant polymer as one component of the polymer blend and a fiber-forming polymer as the other component of the polymer blend, the phase of the fiber-forming polymer is protected by the phase of the heat-resistant polymer, so that the heat resistance of the fibers is remarkably improved.

The size of the phase separation structure of the polymer blend fibers of the present invention is very small; for example, the diameter $D_1$ on a circle basis of the island phase of the sea-island structure in a transverse cross-section of the fibers is in the range of 0.001 to 0.4 $\mu$m. Because of this, the polymer blend fibers have less nonuniformity in the phase separation structure. Specifically, the polymer blend fibers have outstanding mechanical characteristics while having a phase separation structure.

Furthermore, the polymer blend fibers of the present invention have small variation in size of the phase separation structure represented by a variation index. Thus, the polymer blend fibers of the present invention do not have problems associated with causing defects such as voids in the subsequent production step (in particular, drawing step). This indicates that the polymer blend fibers of the present invention have stable quality.

Furthermore, the polymer blend fibers of the present invention have a very uniform phase separation structure in three dimensions (that is, a phase separation structure having a disperse phase which is not flattened in the fiber axis direction and having a very small ratio $D_2/D_1$ of diameters on a circle basis between the transverse cross-section and the longitudinal cross-section of the fibers). Such polymer blend fibers can be provided with a microporous structure on the surface thereof by extracting the disperse phase to form a spongy structure. As a result, the fibers can be provided with very outstanding dyeability and touch.

According to the method for producing the polymer blend fibers of the present invention, a polymer blend melt is extruded from a single nozzle, and a phase separation structure is thermodynamically formed in the fibers. Unlike the conventional method of physically mixing polymer melts at a time of extrusion, polymer molecules constituting the polymer blend can be moved in the fibers under the condition that the mobility of the polymer molecules is controlled. Thus, a variety of phase separation structure can be formed under the condition of being precisely controlled. As a result, the polymer blend fibers obtained by the method of the present invention can be provided with various functions to a desired degree depending upon the use.

Furthermore, according to the method of the present invention, a mechanical load (e.g., shearing stress caused when the polymer blend melt passes through the nozzle) is not applied to the polymer blend melt when a phase separation structure is formed. Thus, the phase separation structure is neither stretched nor deformed. Consequently, fibers having a phase separation structure very uniform in three dimensions can be obtained.

EXAMPLES

Hereinafter, the present invention will be described by way of illustrative examples. It should be noted that the present invention is not limited to the examples. The evaluation items in the examples of the present invention are as follows.

(1) Observation of configuration of phase separation structure

A transverse cross-section and a longitudinal cross-section of fibers cut by a microtome were observed by an electron microscope. An observation method by the electron microscope was varied depending upon the combination of polymers constituting a polymer blend.

(i) Polymer blend one of polymers contained in which is soluble in solvent

Fibers were cut, and the cut fibers were soaked in a solvent capable of dissolving only one polymer until the weight of the cut fibers decreased by 20%. The soaked fibers were dried and observed by a scanning electron microscope (SEM).

(ii) Polymer blend one of polymers contained in which has double bond

Fibers were cut, and the cut fibers were dyed with osmium tetroxide ($OsO_4$). The dyed fibers were observed by a transmission type electron microscope (TEM).

(iii) Polymer blend one of polymers contained in which is aromatic polymer

Fibers were cut, and the cut fibers were dyed with ruthenium tetroxide ($RuO_4$). The dyed fibers were observed by a TEM.

(iv) Polymer blend one of polymer contained in which has amide bond

Fibers were cut, and the cut fibers were dyed with phosphotungstic acid. The dyed fibers were observed by a TEM.

(2) Diameter D on a circle basis, average area X of disperse phase, and variation index Y The diameter D on a circle basis, the average area X of a disperse phase, and the variation index Y were determined regarding the sea-island structure, the modulated structure, and the spongy structure, respectively as follows. Regarding the diameter on a circle basis, the diameter on a circle basis in a transverse cross-section of fibers and the diameter on a circle basis in a longitudinal cross-section of fibers were assumed to be $D_1$ and $D_2$, respectively.

(i) Sea-island structure

Twenty island phases were arbitrarily selected from an electron microphotograph in a transverse cross-section or a longitudinal cross-section of fibers in a predetermined magnification. The area of each island phase was calculated from the weight of the entire microphotograph and the weight of cut-out portions corresponding to the selected island phases. The areas of 20 island phases were averaged, and the average was assumed to be an average area X. Furthermore, the diameter D on a circle basis was determined by using the following formula of a circle.

$$D=2\cdot(X/\pi)^{1/2}$$

Variation index Y was determined by the following formula:

$$Y=(X_{Max}-X_{min})/X$$

where X is the above-mentioned average area, $X_{max}$ is an average of the largest 3 areas of the arbitrarily selected 20 island phases, and $X_{min}$ is an average of the smallest 3 areas of the arbitrarily selected 20 island phases.

(ii) Modulated structure

A straight line was arbitrarily drawn along the transverse cross-section or the longitudinal cross-section of the fibers in the electron microphotograph. A distance of the disperse phase, which this straight line passed through, was assumed to be d. The average of d of arbitrarily selected 20 island phases was assumed to be the diameter D on a circle basis. The average area X and the variation index Y were not obtained.

(iii.) Spongy structure

The diameter D on a circle basis of the hollow portions was determined in the same way as in the modulated structure. The average area X and the variation index Y were not obtained.

(3) Evaluation of compatibility

A polymer blend was dissolved in an appropriate solvent, and a film was formed by a solvent cast method. The film thus obtained was heat-treated at a predetermined temperature for 5 hours and was observed by an optical microscope to see whether or not the film was phase-separated. The observation was conducted by appropriately varying the blend ratio and the heat treatment temperature. It was assumed that a polymer blend exhibiting a one-phase state at any heat treatment temperature irrespective of the blend ratio was a compatible polymer blend; a polymer blend exhibiting a phase separation state at any heat treatment temperature irrespective of the blend ratio was an incompatible polymer blend; and a polymer blend exhibiting a one-phase state or a phase separation state depending upon the blend ratio or the heat treatment temperature was a partial compatible polymer blend.

(4) Evaluation of extrusion property

The case where the fluctuation of a nozzle back pressure at a time of extrusion was 5 kg/cm$^2$ or less was evaluated to be satisfactory extrusion property (represented by O in Table 1). The case where the fluctuation of a nozzle back pressure at a time of extrusion was more than 5 kg/cm$^2$ was evaluated to be unsatisfactory extrusion property (represented by X in Table 1).

(5) Evaluation of end breakage property

A polymer blend melt was extruded in a predetermined extrusion amount and was taken up at a taking-up speed of 500 m/min. to form polymer blend fibers. The case where the time of end breakage was one or less per 20 min. was evaluated to be a satisfactory end breakage property (represented by O in Table 1). The case where the time of end breakage was more than one per 20 min. was evaluated to be unsatisfactory end breakage (represented by X in Table 1).

(6) Evaluation of productivity

A polymer blend melt was extruded in a predetermined extrusion amount and was taken up at five different taking-up speeds: 500 m/min. 1,000 m/min., 2,000 m/min., 3,000 m/min., and 4,000 m/min. to form polymer blend fibers. The highest taking-up speed at which the polymer blend melt was capable of being taken up without being broken over 30 minutes was assumed to be a highest spinning speed, which was used as an indicator for evaluation of productivity. Specifically, as the highest spinning speed is higher, productivity is more satisfactory.

(7) Evaluation of drawing property

Drawn yarn thus obtained was observed by an optical microscope. The case where the number of voids per 10,000 $\mu m^2$ was 5 or less was evaluated to be a satisfactory drawing property (represented by O in Table 1). The case where the number of voids per 10,000 $\mu m^2$ was more than 5 was evaluated to be an unsatisfactory drawing property (represented by X in Table 1).

Example 1

As one of polymers constituting a polymer blend, a polyethyleneterephthalate-polyethylenenaphthalate copolymer containing an ethyleneterephthalate unit and an ethylenenaphthalate unit in a molar ratio of 90:10 was copolymerized by a known method. Then, 0.2 g of the copolymer was dissolved in 50 ml of mixed solvent containing phenol/tetrachloroethane (60/40 (weight ratio)). The resultant solution was measured for intrinsic viscosity by an Ostwald viscometer at 30° C. to be 0.6. As the other one of polymers constituting the polymer blend, polyetherimide (ULTEM-1000, produced by General Electric Co., Ltd.) represented by the following Chemical Formula II was used. The crystallinity of the copolymer and polyetherimide was evaluated by DSC, indicating that the copolymer was a crystalline polymer and polyetherimide was an amorphous polymer. Furthermore, the compatibility of the blend containing the copolymer and the polyetherimide was evaluated, indicating that the blend was a partial compatible polymer blend with UCST.

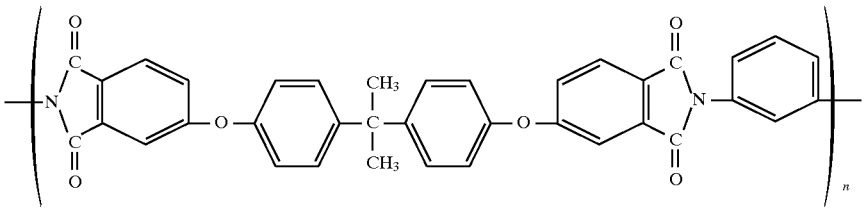

(II)

Pellets for spinning were prepared by using the polymer blend as follows.

(1) The above-mentioned copolymer and the above-mentioned polyetherimide were melt-kneaded in a blend ratio of 70:30 (weight ratio) at a cylinder temperature of 320° C. and extruded by using a twin-screw extruder with a screw diameter of 30 mm; (2) strands thus extruded were cut; and (3) the cut strands were dried in vacuo at 120° C. for 8 hours. The pellets thus obtained were extruded at a nozzle plate temperature of 315° C. and an extrusion amount of 3.6 g/min. by using a spinning apparatus having 6 nozzle plates. The extruded pellets were taken up at a taking-up speed of 500 m/min. to obtain undrawn yarn. The highest spinning speed was 4,000 m/min.

Then, the undrawn yarn was drawn by a drawing machine equipped with a heating roller and a heating plate at a heating roller temperature of 90° C., a heating plate temperature of 140° C., and a drawing ratio of 3.0, thus obtaining drawn yarn. The drawn yarn thus obtained was observed by an optical microscope, indicating that the yarn was drawn satisfactorily without any defects such as voids. This drawn yarn was observed by an electron microscope, indicating that a sea-island structure was formed. $D_1$ of the drawn yarn was 0.002 $\mu$m, Y was 1.3, and $D_2/D_1$ was 1.3. The phase separation structure was very fine and uniform compared with that of the conventional polymer blend fibers. Furthermore, the phase separation structure had a novel configuration that the island phase is less flattened in the fiber axis direction.

The results of the above-mentioned evaluations (1) to (7) of the fibers thus obtained are shown in Table 1 together with the results of Examples 2 to 7 and Comparative Examples 1 to 6 described below.

TABLE 1

| | | Spinning characteristics | | | | Phase separation structure | | | |
|---|---|---|---|---|---|---|---|---|---|
| | Compatibility | Extrusion property | End breakage property | The highest spinning speed | Drawing property | $D_1$ ($\mu$m) | Y | $D_2/D_1$ | Configuration |
| Example 1 | Partial compatible | ○ | ○ | 4000 m/min | ○ | 0.002 | 1.3 | 1.3 | Sea-island |
| Example 2 | Partial compatible | ○ | ○ | 4000 m/min | ○ | 0.3 | 1.4 | 1.3 | Sea-island |
| Example 3 | Partial compatible | ○ | ○ | 4000 m/min | — | 0.01 | 1.3 | — | Modulated |
| Example 4 | Partial compatible | ○ | ○ | 4000 m/min | — | 0.08 | 1.3 | 1.0 | Sea-island |
| Example 5 | Partial compatible | ○ | ○ | 4000 m/min | — | 0.4 | 1.6 | 1.0 | Sea-island |
| Example 6 | Partial compatible | ○ | ○ | 4000 m/min | — | — | — | — | Spongy |
| Example 7 | Partial compatible | ○ | ○ | 4000 m/min | ○ | 0.001 | 1.3 | 1.3 | Sea-island |
| Comparative Example 1 | Partial compatible | x | x | *1 | x | *1 | *1 | *1 | *1 |
| Comparative Example 2 | Incompatible | x | x | 500 m/min | x | 1.2 | 2.6 | 9.4 | Sea-island |
| Comparative Example 3 | Incompatible | x | x | 500 m/min | x | 1.6 | 2.7 | 5.8 | Sea-island |
| Comparative Example 4 | Incompatible | x | x | 500 m/min | x | 1.6 | 2.7 | 5.2 | Sea-island |
| Comparative Example 5 | Incompatible | x | x | 500 m/min | x | 1.5 | 2.8 | 7.6 | Sea-island |
| Comparative Example 6 | Compatible | ○ | ○ | 4000 m/min | ○ | *2 | *2 | *2 | One-phase |

*1: Undrawn yarn was not able to be obtained.
*2: Phase separation structure was not formed.

Example 2

Drawn yarn was obtained in the same way as in Example 1 except that the heating plate temperature was 170° C. during the drawing step. The drawn yarn was observed by an electron microscope, indicating that a sea-island structure was formed therein. $D_1$ of the drawn yarn was 0.002 $\mu$m, Y was 1.3, and $D_2/D_1$ was 1.3. The phase separation structure was very fine and uniform compared with that of the conventional polymer blend fibers. Furthermore, the phase separation structure had a novel configuration that the island phase is less flattened in the fiber axis direction.

Example 3

Undrawn yarn obtained in the same way as in Example 1 was heat-treated at 180° C. for 20 seconds. The undrawn yarn thus heat-treated was observed by an electron microscope, indicating that a modulated structure was formed therein. $D_1$ of the undrawn yarn was 0.01 $\mu$m.

Example 4

Undrawn yarn was obtained in the same way as in Example 3 except that the heating treatment time was 60 seconds. The undrawn yarn thus heat-treated was observed by an electron microscope, indicating that a sea-island structure was formed therein. $D_1$ of the undrawn yarn was 0.08 $\mu$m, Y was 1.3, and $D_2/D_1$ was 1.0. The phase separation structure was very fine and uniform compared with that of the conventional polymer blend fibers. Furthermore, the phase separation structure had a novel configuration that the island phase is less flattened in the fiber axis direction.

Example 5

Undrawn yarn was obtained in the same way as in Example 3 except that the heating treatment time was 300 seconds. The undrawn yarn thus heat-treated was observed by an electron microscope, indicating that a sea-island structure was formed therein. $D_1$ of the undrawn yarn was 0.4 $\mu$m, Y was 1.6, and $D_2/D_1$ was 1.0. The phase separation structure was very fine and uniform compared with that of the conventional polymer blend fibers. Furthermore, the phase separation structure had a novel configuration that the island phase is less flattened in the fiber axis direction.

Example 6

Drawn yarn was obtained in the same way as in Example 1 except that the heating plate temperature was 120° C. during the drawing step. The drawn yarn was woven and soaked in 60 g/l of NaOH aqueous solution at 90° C. for 2 hours, whereby the yarn was subjected to an alkaline reduction treatment. The fiber surface of the fabric thus obtained was observed by an electron microscope, indicating that a spongy structure was formed therein. $D_1$ of the fibers forming the fabric was 0.01 $\mu$m. Furthermore, the touch of the fabric had unique dry touch which was completely different from that obtained by subjecting fabric made of conventional fibers to alkaline reduction treatment.

Example 7

As one of the polymers constituting a polymer blend, a polyethyleneterephthalate-polyethylenenaphthalate copolymer containing an ethyleneterephthalate unit and an ethylenenaphthalate unit in a molar ratio of 95:5 was copolymerized by a known method. Then, 0.2 g of the copolymer was dissolved in 50 ml of mixed solvent containing phenol/tetrachloroethane (60/40 (weight ratio)). The resultant solution was measured for intrinsic viscosity by an Ostwald viscometer at 30° C. to be 0.6. As the other one of polymers constituting the polymer blend, polyetherimide (ULTEM- 1000, produced by General Electric Co., Ltd.) represented by the following Chemical Formula. II was used. The crystallinity of the copolymer and polyetherimide was evaluated by DSC, indicating that the copolymer was a crystalline polymer and polyetherimide was an amorphous polymer. Furthermore, the compatibility of the blend containing the copolymer and the polyetherimide was evaluated, indicating that the blend was a partial compatible polymer blend with UCST.

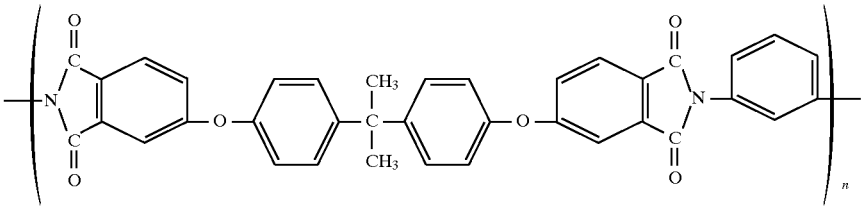

(II)

Pellets for spinning were prepared by using the polymer blend as follows.

(1) The above-mentioned copolymer and the above-mentioned polyetherimide were melt-kneaded in a blend ratio of 90:10 (weight ratio) at a cylinder temperature of 320° C. and extruded by using a twin-screw extruder with a screw diameter of 30 mm; (2) strands thus extruded were cut; and (3) the cut strands were dried in vacuo at 120° C. for 8 hours. The pellets thus obtained were extruded at a nozzle plate temperature of 315° C. and a extrusion amount of 3.6 g/min. by using a spinning apparatus having 6 nozzle plates. The extruded pellets were taken up at a taking-up speed of 500 m/min. to obtain undrawn yarn. The highest spinning speed was 4,000 m/min.

Then, the undrawn yarn was drawn by a drawing machine equipped with a heating roller and a heating plate at a heating roller temperature of 90° C., a heating plate temperature of 140° C., and a drawing ratio of 4.2, thus obtaining drawn yarn. The drawn yarn thus obtained was observed by an optical microscope, indicating that the yarn was drawn satisfactorily without any defects such as voids. This drawn yarn was observed by an electron microscope, indicating that a sea-island structure was formed. $D_1$ of the drawn yarn was 0.001 $\mu$m, Y was 1.3, and $D_2/D_1$ was 1.3. The phase separation structure was very fine and uniform compared with that of the conventional polymer blend fibers. Furthermore, the phase separation structure had a novel configuration that the island phase is less flattened in the fiber axis direction.

Comparative Example 1

A polymer blend was used, which contained polyester having a weight average molecular weight of 3500 and polybutadiene having a weight average molecular weight of 2500 both of which were amorphous polymers. This polymer blend was a partial compatible polymer blend.

Pellets for spinning were prepared by using this polymer blend as follows.

(1) Polystyrene and polybutadiene were melt-kneaded in a blend ratio of 80:20 (weight ratio) at a cylinder temperature of 220° C. and extruded by using a twin-screw extruder with a screw diameter of 30 mm; (2) strands thus extruded were cut; and (3) the cut strands were dried in vacuo at 70° C. for 12 hours. Fibers were tried to be formed from the pellets thus obtained at various extrusion amounts, nozzle plate temperatures, and taking-up speeds, by using a spinning apparatus having 6 nozzle plates. As a result, a number of end breakages occurred; thus, undrawn yarn was not able to be obtained.

Comparative Example 2

A polymer blend was used, which contained nylon 6 and polypropylene both of which were amorphous polymers. This polymer blend was an incompatible polymer blend.

Pellets for spinning were prepared by using this polymer blend as follows.

(1) Nylon 6 and polypropylene were melt-kneaded in a blend ratio of 90:10 (weight ratio) at a cylinder temperature of 280° C. and extruded by using a twin-screw extruder with a screw diameter of 30 mm; (2) strands thus extruded were cut; and (3) the cut strands were dried in vacuo at 120° C. for 8 hours. The pellets were extruded at an extrusion amount of 3.6 g/min. and a nozzle plate temperature of 280° C. by using a spinning apparatus having 6 nozzle plates. Then, the extruded pellets were taken up at a taking-up speed of 500 m/min. At this time, a nozzle back pressure was changed to cause a number of end breakages; therefore, undrawn yarn was obtained in only a small amount.

Then, the undrawn yarn was drawn by using a drawing machine equipped with a heating roller and a heating plate at a heating roller temperature of 40° C., a heating plate temperature of 120° C., and a drawing ratio of 2.5, thus obtaining drawn yarn. The drawn yarn was observed by an optical microscope, indicating that the yarn was not satisfactorily drawn with a number of defects such as voids. The drawn yarn was observed by an electron microscope, indicating that a sea-island structure was formed therein. $D_1$ of the drawn yarn was 1.2 $\mu$m, Y was 2.6, and $D_2/D_1$ was 9.4.

Comparative Example 3

Undrawn yarn obtained in the same way as in Comparative Example 2 was heat-treated at 100° C. for 20 seconds. The undrawn yarn thus heat-treated was observed by an electron microscope, indicating that a sea-island structure was formed therein. $D_1$ of the undrawn yarn was 1.6 $\mu$m, Y was 2.7, and $D_2/D_1$ was 5.8.

Comparative Example 4

Undrawn yarn was obtained in the same way as in Comparative Example 3 except that the heating time was 300 seconds. The undrawn yarn thus heat-treated was observed by an electron microscope, indicating that a sea-island structure was formed therein. $D_1$ of the undrawn yarn was 1.6 $\mu$m, Y was 2.7, and $D_2/D_1$ was 5.2.

Comparative Example 5

As one of polymers constituting a polymer blend, a polyethyleneterephthalate-polyethylenenaphthalate copolymer containing an ethyleneterephthalate unit and an ethylenenaphthalate unit in a molar ratio of 99:1 was copolymerized by a known method. Then, 0.2 g of the copolymer was dissolved in 50 ml of mixed solvent containing phenol/tetrachloroethane (60/40 (weight ratio)). The resultant solution was measured for intrinsic viscosity by an Ostwald viscometer at 30° C. to be 0.6. As the other one of polymers constituting the polymer blend, polyetherimide (ULTEM-1000, produced by General Electric Co., Ltd.) represented by the following Chemical Formula II was used. This polymer blend was incompatible polymer blend.

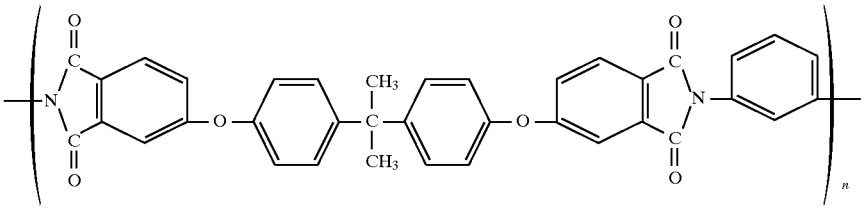

(II)

Pellets for spinning were prepared by using the polymer blend as follows.

(1) The above-mentioned copolymer and the above-mentioned polyetherimide were melt-kneaded in a blend ratio of 70:30 (weight ratio) at a cylinder temperature of 320° C. and extruded by using a twin-screw extruder with a screw diameter of 30 mm; (2) strands thus extruded were cut; and (3) the cut strands were dried in vacuo at 120° C. for 8 hours. The pellets thus obtained were extruded at a nozzle plate temperature of 315° C. and an extrusion amount of 3.6 g/min. by using a spinning apparatus having 6 nozzle plates. The extruded pellets were taken up at a taking-up speed of 500 m/min. At this time, a nozzle back pressure was changed to cause a number of end breakages; therefore, undrawn yarn was obtained only in a small amount.

Then, the undrawn yarn was drawn by a drawing machine equipped with a heating roller and a heating plate at a heating roller temperature of 90° C., a heating plate temperature of 140° C., and a drawing ratio of 3.0, thus obtaining drawn yarn. The drawn yarn thus obtained was observed by an optical microscope, indicating that the yarn was not drawn satisfactorily with a number of defects such as voids. This drawn yarn was observed by an electron microscope, indicating that a sea-island structure was formed. $D_1$ of the drawn yarn was 1.5 $\mu$m, Y was 2.8, and $D_2/D_1$ was 7.6.

Comparative Example 6

As one of the polymers constituting a polymer blend, a polyethyleneterephthalate-polyethylenenaphthalate copolymer containing an ethyleneterephthalate unit and an ethylenenaphthalate unit in a molar ratio of 45:55 was copolymerized by a known method. Then, 0.2 g of the copolymer was dissolved in 50 ml of mixed solvent containing phenol/tetrachloroethane (60/40 (weight ratio)). The resultant solution was measured for intrinsic viscosity by an Ostwald viscometer at 30° C. to be 0.6. As the other one of polymers constituting the polymer blend, polyetherimide (ULTEM-1000, produced by General Electric Co., Ltd.) represented by the following Chemical Formula II was used. This polymer blend was compatible polymer blend.

Pellets for spinning were prepared by using the polymer blend as follows.

(1) The above-mentioned copolymer and the above-mentioned polyetherimide were melt-kneaded in a blend ratio of 70:30 (weight ratio) at a cylinder temperature of 320° C. and extruded by using a twin-screw extruder with a screw diameter of 30 mm; (2) strands thus extruded were cut; and (3) the cut strands were dried in vacuo at 120° C. for 8 hours. The pellets thus obtained were extruded at a nozzle plate temperature of 315° C. and an extrusion amount of 3.6 g/min. by using a spinning apparatus having 6 nozzle plates. The extruded pellets were taken up at a taking-up speed of 500 m/min. to obtain undrawn yarn. The highest spinning speed was 4,000 m/min.

Then, the undrawn yarn was drawn by a drawing machine equipped with a heating roller and a heating plate at a heating roller temperature of 90° C., a heating plate temperature of 140° C., and a drawing ratio of 3.0, thus obtaining drawn yarn. The drawn yarn thus obtained was observed by an optical microscope, indicating that the yarn was drawn satisfactorily without any defects such as voids. This drawn yarn was observed by an electron microscope, indicating that a phase separation structure was not formed.

As is apparent from Table 1, the polymer blend fibers of the present invention have outstanding an extrusion property, an end breakage property, productivity, and a drawing property. Furthermore, the polymer blend fibers of the present invention have a precisely controlled fine phase separation structure, so that the present invention can be applied in a very wide range.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. Spongy structure polymer fibers having uniformly dispersed interconnected pore spaces having an aspect ratio of $D_2/D_1 \leqq 2$, said $D_1$ is a diameter on a circle basis of a transverse cross-section of said fibers and said $D_2$ is a diameter on a circle basis of a longitudinal cross-section of said fibers, wherein the fibers having the interconnected pore

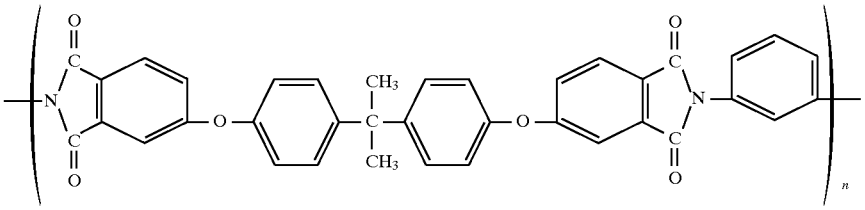

(II)

spaces are formed from polymer blend starting fibers having a phase separated structure comprising two phases by extracting and removing one phase from said polymer blend starting fibers and said diameter $D_1$ is in the range of 0.001 to 5 μm.

2. Spongy structure polymer fibers according to claim 1, wherein the diameter $D_1$ on a circle basis of the hollow portion of the spongy structure in the transverse cross-section of the fibers is in the range of 0.001 to 0.4 μm.

3. Spongy structure polymer fibers according to claim 2, wherein the diameter $D_1$ on a circle basis of the hollow portion of the spongy structure in the transverse cross-section of the fibers is in the range of 0.005 to 0.1 μm.

4. Spongy structure polymer fibers according to claim 3, wherein the diameter $D_1$ on a circle basis of the hollow portion of the spongy structure in the transverse cross-section of the fibers is in the range of 0.01 to 0.1 μm.

5. Spongy structure polymer fibers according to claim 1, wherein the polymer blend starting fibers comprise a partially compatible polymer blend.

6. Spongy structure polymer fibers according to claim 5, wherein the partial compatible polymer blend has an upper critical solution temperature.

7. Spongy structure polymer fibers according to claim 5, wherein the partial compatible polymer blend contains a copolymer having a degree of polymerization of 50 or more.

8. Spongy structure polymer fibers according to claim 7, wherein the copolymer has ethyleneterephthalate as a monomer unit.

9. Spongy structure polymer fibers according to claim 8, wherein the partial compatible polymer blend is a blend containing a polyethyleneterephthalate-polyethylenenaphthalate copolymer and a polyetherimide.

10. Spongy structure polymer fibers according to claim 9, wherein a molar ratio between an ethyleneterephthalate unit and an ethylenenaphthalate unit in the polyethyleneterephthalate-polyethylenenaphthalate copolymer is in the range of 98:2 to 50:50.

11. Spongy structure polymer fibers according to claim 9, wherein the polyetherimide is represented by the following Chemical Formula I:

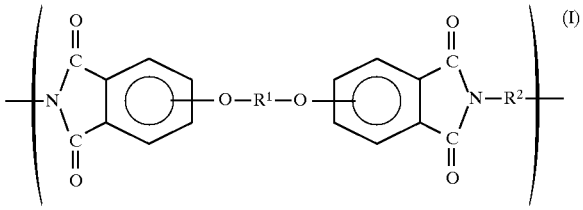

(I)

where $R^1$ is a divalent aromatic group having 6 to 30 carbon atoms, and $R^2$ is a divalent aromatic group having 6 to 30 carbon atoms, an alkylene group or a cycloalkylene group having 2 to 20 carbon atoms, or an organopolysiloxane group which is chain-terminated with an alkylene group having 2 to 8 carbon atoms.

12. Spongy structure polymer fibers according to claim 1, wherein the polymer blend starting fibers comprise a polymer having a high degree of polymerization and a polymer having a low degree of polymerization, and a degree of polymerization $n_1$ of the polymer having a high degree of polymerization and a degree of polymerization $n_2$ of the polymer having a low degree of polymerization have a relationship of $n_1/n_2 \leqq 50$.

13. Spongy structure polymer fibers according to claim 1, wherein the polymer blend starting fibers comprise a crystalline polymer.

14. Spongy structure polymer fibers according to claim 1, wherein the polymer blend starting fibers comprise polystyrene and poly-ε-caprolactone.

* * * * *